United States Patent [19]

Maurice et al.

[11] Patent Number: 4,554,137

[45] Date of Patent: Nov. 19, 1985

[54] ENRICHMENT OF MINERALS BY FLOTATION AND COLLECTOR AGENTS EMPLOYED FOR THIS PURPOSE

[75] Inventors: Jacques Maurice; Patrice Guesnet, both of Pau; Pierre Tozzolino, Morlaas; Guy Muller, Monein, all of France

[73] Assignee: Societe Nationale Elf Aquitaine (Production), France

[21] Appl. No.: 541,776

[22] Filed: Oct. 13, 1983

[30] Foreign Application Priority Data

Oct. 13, 1982 [FR] France ..... 8217128

[51] Int. Cl.[4] ..... B03D 1/02

[52] U.S. Cl. ..... 423/26; 75/2; 209/167

[58] Field of Search ..... 75/2, 117; 423/26; 209/167, 166

[56] References Cited

U.S. PATENT DOCUMENTS 3,059,774 10/1962 Wilson ..... 209/167

4,341,626 7/1982 Dauplaise et al. ..... 209/167

*Primary Examiner*—L. Dewayne Rutledge

*Assistant Examiner*—S. Kastler

*Attorney, Agent, or Firm*—Ostrolenk, Faber, Gerb & Soffen

[57] ABSTRACT

Process of enrichment of minerals by flotation by means of a collector comprising a thio-compound, the thio-compound being a straight or branched dialkyl or dialkenyl polysulphide.

7 Claims, No Drawings

ENRICHMENT OF MINERALS BY FLOTATION AND COLLECTOR AGENTS EMPLOYED FOR THIS PURPOSE

The present invention relates to the enrichment of minerals by flotation with organic collectors constituted by thio-compounds. It relates more particularly to the treatment of minerals based on oxides and sulphides of heavy metals.

Compounds containing sulphur in their molecules have been successfully employed in the flotation technique: this is particularly the case with the alkali metal alkyl xanthates, which are among the best collectors known at present. However, alkyl mercaptans are also regarded as good collectors, particularly $C_{12}$ to $C_{16}$, which—despite their low solubility in water—have been advantageously utilized, when emulsified with surfactant compounds.

The present invention is based on the discovery that the collector properties of a thio-compound can be intensified by a certain accumulation of sulphur atoms in the molecules of these compounds. Thus, it has been found that dialkyl polysulphides can give better results than the corresponding mercaptans; this is theoretically surprising, because polysulphides have a molecular structure containing two lipophilic chains. This fact is all the more unexpected as the alkyl polysulphides higher than $C_8$ are even less soluble in water than the mercaptans.

The process according to the invention consists in effecting the flotation of the mineral or minerals in a general manner known per se, but with at least one di-hydrocarbyl polysulphide as a collector or in conjunction with a collector of the known type, the one or more polysulphides being represented by the formula:

$$R-S_x-R'$$

where R and R′ are the same or different and are alkyl or alkenyl groups, which can carry substituents, and x is a number having an average value of 2 to 8.

The substituents of the hydrocarbon groups R and/or R′ can be other aliphatic, cyclo-aliphatic or aryl radicals, halogens, nitriles or functional groups, for example OH, -COOH, $NO_2$, $CONH_2$, esters, carbonyls etc. Functional substituents giving affinity with water are particularly favourable.

In practice, the groups R and/or R′ are generally $C_1$ to $C_{18}$, straight or branched, and particularly $C_4$ to $C_{12}$.

A mode of preparation of such polysulphides is known, which consists in treating for example the corresponding mercaptan with sulphur, in the presence of an amine as catalyst, according to the reaction:

$$2RSH+(x-1)S \text{ amine } RS_xR+H_2S$$

This process in fact provides a mixture of polysulphides having various numbers of S atoms, x thus being an average of these numbers.

Although starting with $C_8$, the polysulphides according to the invention are practically insoluble in water, they can be introduced into the mineral pulp to be treated in the form of a solution in a solvent, or as an emulsion or as an extremely fine dispersion. Thus, the polysulphide can be employed in solution in alcohol, carbon disulphide, dimethyl sulphoxide, benzene, kerosene, oil or other appropriate solvent. The emulsion can be produced by mixing with a surfactant liquid, such as a polyol or a polyethoxylated alkyl-phenol, a petroleum sulphonate, a polyalkoxylated mercaptan, an ester of a polyoxyalkylene fatty acid or of sorbitan, etc. As regards the aqueous or other dispersion, it can be obtained by wet mircronisation.

The molar proportions of the new collectors according to the invention employed in flotation are the same as those of the known technique, that is generally about 0.05 to 1.5 and, more particularly, 0.1 to 0.25 mole per tonne of mineral.

The Examples which follow illustrate the invention non-limitatively.

EXAMPLES 1 to 6

A series of flotation tests is effected with a sulphide mineral of copper obtained from the South African mine at Palabora, containing 0.45 to 0.48% Cu. 600 g of this mineral is ground to a fineness such that 76% of the powder passes through a screen having 148 micron meshes.

After adding the necessary adjuvants, the product is subjected to flotation for 20 minutes at pH 7.5, in a 2.5 liter laboratory cell of the Minemet M 130 type, in the presence of methyl-isobutyl-carbinol as a wetting agent added at the rate of 25 g per tonne of mineral.

The collectors are introduced in the form of mixtures of 57.5% by weight of the thio-compounds with 42.5% of the surfactant, polyoxyethylene nonyl phenol, known commercially under the name "SIMULSOL 730". They are, on the one hand, (Examples 1 and 2) the mercaptans usually used in flotation and, on the other hand, (Examples 3 to 6) polysulphides according to the invention; their proportion in millimoles per tonne of mineral is indicated in the results Table which follows. The last two columns in this Table indicate the percentage Cu content in the concentrate obtained, as well as the percentage of Cu recovered.

| Ex. No. | Collector | Millimoles per tonne | Conc. % Cu | % Cu recovered |
|---|---|---|---|---|
| 1 | n-dodecyl-mercaptan | 173 | 10.4 | 30.4 |
| 2 | tert.dodecyl-mercaptan | " | 9.4 | 61.0 |
| 3 | di-tert.dodecyl-pentasulphide | " | 14.5 | 66.7 |
| 4 | di-tert.dodecyl-pentasulphide | 124 | 13.3 | 48.0 |
| 5 | di-tert.dodecyl-trisulphide | 173 | 13.7 | 20.5 |
| 6 | di-tert.nonyl-trisulphide | " | 11.6 | 19.7 |
| 7 | di-tert.nonyl-pentasulphide | " | 12.7 | 58 |

Thus the concentrations of Cu obtained are always better with the polysulphides than those given by known collectors. Also, in equal molar proportions, the pentasulphides permit a recovery of copper comparable or superior to that of the mercaptans.

EXAMPLES 7 to 14

Flotation tests are effected with each of the minerals designated in the results Table by:

CHAL. —for chalcopyrite,
GAL. —for galena
BL. —for blende and
PYR. —for pyrites.

265 ml of water, 1 g of fine powder of the mineral and $3\times10^{-4}$ g of the collector to be tested, per liter, are introduced into a cell; this collector is utilized in the form of a 1% solution in ethanol.

The Table below gives the percentage of each mineral recovered as the product of the flotation.

| Ex. No | Collector | % of mineral recovered CHAL. | GAL. | BL. | PYR. |
|---|---|---|---|---|---|
| 8 | Dihexyl-disulphide | 94 | 88 | 84 | 90 |
| 9 | Lauryl-ethyl-disulphide $C_{12}H_{25}SSC_2H_5$ | 92 | — | 91 | — |
| 10 | Dilauryl-disulphide $C_{12}H_{25}SSC_{12}H_{25}$ | 88 | — | 89 | 87 |
| 11 | Dihexyl-trisulphide $C_6H_{13}SSSC_6H_{13}$ | 92 | 87 | 76 | 88 |
| 12 | Dilauryl-trisulphide $C_{12}H_{25}SSSC_{12}H_{25}$ | 95 | 91 | 73 | 84 |
| 13 | Dilauryl-pentasulphide $C_{12}H_{25}S_5C_{12}H_{25}$ | 88 | 93 | 69 | 79 |
| 14 | n-Dodecyl-mercaptan | 81 | 87 | 64 | 73 |

It can be seen that the polysulphides of Examples 8 to 13 give bettwer results than those given by n-dodecyl mercaptan (Example 14) currently employed at the present time.

EXAMPLES 15 to 20

Assey on chalcopyrite with $3\times10^{-4}$ g/l of collector.

| Ex. No. | Collector | pH | Results % 7 | 8 | 9 | 10 |
|---|---|---|---|---|---|---|
| 15 | $C_6H_{13}S_2C_6H_{13}$ | | 46% | 45% | 45% | 42% |
| 16 | $C_{12}H_{25}S_2C_{12}H_{25}$ | | 54% | 49% | 47% | 46% |
| 17 | $C_{12}H_{25}S_2C_2H_5$ | | 44% | 44% | 44% | 37% |
| 18 | $C_6H_{13}S_3C_6H_{13}$ | | 48% | 43% | 41% | 40% |
| 19 | t $C_{12}H_{25}S_3$ t$C_{12}H_{25}$ | | 88% | 86% | 86% | 88% |
| 20 | t $C_{12}H_{25}S_5$ t$C_{12}H_{25}$ | | 85% | 85% | 85% | 85% |

It can be seen that when the collector has two S atoms and six or less carbon atom alkyl groups, the results are poorer.

We claim:

1. Process of enrichment of minerals by flotation with the aid of a collector consisting essentially of a polysulphide having two aliphatic hydrocarbon groups, wherein these groups are alkyl or alkenyl, one group having 2 to 12 carbon atoms and the other having 6 to 12 carbon atoms, and wherein the polysulphide is in the form of a solution in a solvent selected from the group consisting of alcohol, carbon disulphide, dimethyl sulphoxide, benzene and kerosene.

2. Process according to claim 1 wherein the solvent is ethyl alcohol.

3. Process according to claim 2 wherein the collector is selected from the group consisting of dihexyl disulphide, lauryl-ethyl-disulphide, dilauryl disulphide, dihexyl trisulphide, dilauryl trisulphide and dilauryl pentasulphide and wherein the amount of collector per ton of mineral is 0.05 to 1.5 mole.

4. Process according to claim 1 wherein the polysulphide is in the form of emulsion with a liquid surfactant.

5. Process according to claim 4 wherein the liquid surfactant is selected from the group consisting of polyol, polyethoxylated alkylphenol, petroleum sulfonate, polyalkoxylated mercaptan, ester of polyoxyalkylene fatty acid and ester of sorbitan.

6. Process according to claim 5 in which the collector is selected from the group consisting of di-tert dodecyl pentasulphide, di-tert dodecyl trisulphide, di-tert nonyl trisulphide and di-tert nonyl pentasulphide, the surfactant is polyoxyethylene alkylphenol and the amount of collector per ton of mineral is 0.05 to 1.5 mole.

7. Process according to claim 1 wherein 0.05 to 1.5 mole of the collector in the form of a solution or emulsion is employed and wherein the collector is selected from the group consisting of di-tert dodecyl pentasulphide, di-tert dodecyl trisulphide, di-tert nonyl trisulphide, di-tert nonyl pentasulphide, di-hexyl disulphide, di-lauryl-disulphide, lauryl-ethyl-disulphide, di-hexyl trisulphide, dilauryl trisulphide, and dilauryl pentasulphide.

* * * * *